United States Patent [19]

Harris

[11] Patent Number: 4,827,230

[45] Date of Patent: May 2, 1989

[54] MAGNET DESIGN FOR FERROMAGNETIC RESONATORS

[75] Inventor: David L. Harris, Hillsboro, Oreg.

[73] Assignee: Tektronix, Inc., Beaverton, Oreg.

[21] Appl. No.: 242,655

[22] Filed: Sep. 12, 1988

[51] Int. Cl.[4] ..... H01P 1/202; H01P 7/06

[52] U.S. Cl. ..... 333/202; 333/207; 333/223; 333/235

[58] Field of Search ..... 333/202, 206, 207, 209, 333/222, 223, 219, 219.1, 227, 231, 235, 245, 248; 335/297-300

[56] References Cited

FOREIGN PATENT DOCUMENTS 2161653 1/1986 United Kingdom ..... 333/202

OTHER PUBLICATIONS

Rhymes, Two-Sphere YIG Multiplier/Filter Ensures Purity, Apr. 1988, Microwaves & RF, pp. 109-116.

Ishikawa & Chikazumi, Design of High Power Electromagnets, Sep. 1962, Japanese Journal of Applied Physics, pp. 155-173.

*Primary Examiner*—Marvin L. Nussbaum

*Attorney, Agent, or Firm*—Boulden G. Griffith

[57] ABSTRACT

A ferrimagnetic resonator has improved high frequency response because a shorter, tapered pole shaft is substituted for the longer pole shafts of uniform dimensions in the prior art. This shorter, tapered shaft alleviates constrictions in the field of the magnetic flux, thus allowing for an improved flux density at the tip of the magnet and correspondingly improved high frequency operation of the ferrimagnetic resonator. In a preferred embodiment, the tip of the pole is replaced with a layer of a higher permeability, but also higher hysteresis, alloy to improve the flux density in the air gap where the ferrimagnetic crystal resonator elements reside. In alternative embodiments, the case end of the pole shaft can attain its greater dimensions because of sides that curve outward or that get larger in a series of steps.

6 Claims, 2 Drawing Sheets

MAGNET DESIGN FOR FERROMAGNETIC RESONATORS

BACKGROUND OF THE INVENTION

The present invention relates to the field of ferrimagnetic resonators and more particularly to the geometry of the physical design of the pole pieces of the electromagnets used in ferrimagnetic resonators so that higher frequency operation can be achieved.

Magnetically tunable filters and oscillators that employ ferrite resonators such a Yttrium-Iron-Garnet (YIG) have for many years used tuning magnets with relatively long cylindrical poles having beveled tips. FIG. 1 shows such a prior art tuning magnet.

In order to minimize hysteresis, the magnet is usually made from an alloy of nickel and iron in approximately equal proportions. However, when this alloy is used with the prior art magnet geometry described above, tuning linearity is lost at frequencies above 20 GHz.

Tuning to higher frequencies with the prior art geometry can be accomplished by using an alloy that can accommodate a higher magnetic flux density. Substituting a cobalt and iron alloy for the nickel and iron alloy permits greater flux densities, and therefore higher frequency operation, but the cobalt and iron alloy has approximately twenty times as much hysteresis as the nickel and iron alloy does. For many applications, this level of hysteresis is entirely unacceptable because the relationship between the current applied to the coils and the resulting frequency becomes difficult to predict, since it depends on the history of prior operation as well as the current presently being applied.

Part of the problem with alternative alloys and the extra hysteresis that they create can be solved by the use of limited quantities of the high hysteresis alloy at the most critical parts of the magnetic pole construction. A small layer of the high hysteresis alloy is used at the tip of the pole to minimize saturation effects, while the rest of the pole is made of a lower hysteresis alloy that saturates more easily. This approach permits an effective trade-off between the two competing goals of maximum magnetic flux density and minimum hysteresis.

Ferrimagnetic resonators have traditionally used a relatively long, cylindrical pole shaft terminating in a beveled tip, with the tip region being much shorter than the pole shaft. Alternative pole geometries have been used in the design of large-scale, high-power magnets, especially in the field of very high power magnets used in research and high energy physics. But these relatively exotic pole geometries have never been applied to the field of ferrimagnetic resonators, such as those employed in YIG filters and oscillators.

What is desired is an electromagnet geometry for ferrimagnetic resonators that will produce higher magnetic flux densities at the tip, without a significant penalty in terms of increased hysteresis, permitting higher frequency operation of the ferrimagnetic resonators.

SUMMARY OF THE INVENTION

The present invention is a ferrimagnetic resonator with an improved high frequency response that arises from the enhanced geometry of the pole piece of the electromagnetic. The geometry of the electromagnet pole piece is improved by substituting a shorter, tapered pole shaft for the longer, cylindrical pole shafts of the prior art. This shorter, tapered shaft alleviates constrictions in the field of the magnetic flux, thus allowing for an improved flux density at the tip of the magnet and correspondingly improved high frequency operation of the ferrimagnetic resonator.

DETAILED DESCRIPTION

Figure 1:
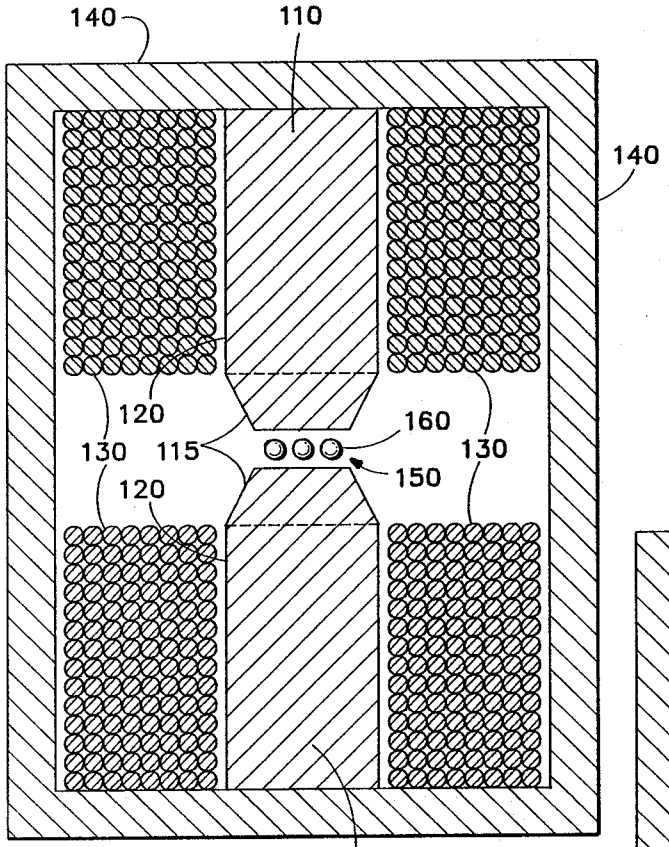
FIG. 1 is an illustration of a prior art tuning magnet for a ferrimagnetic resonator.

Referring first to FIG. 1, the magnetic pole pieces 110 of the prior art have traditionally consisted of two regions: a short beveled tip 115, and a long cylindrical shaft 120. The coils 130 are arranged to focus their magnetic flux fields into the cylindrical shaft portion 120 of the pole pieces 110. A case 140 encloses the pole pieces 110 and the coils 130 and provides a low reluctance return path for the magnetic field between the two pole pieces. Between the two beveled tips 115 there is an air gap 150 that is a region of high reluctance. One or more ferrimagnetic crystal resonator elements 160 are held (by means which are not shown) in the air gap 150 between the two beveled tips 115. The goal is to have a uniformly intense magnetic field in the region of the ferrimagnetic crystal resonator elements 160.

In operation, the voltage applied to the coils 130 causes a current to flow in those coils which produces a magnetic field that is primarily concentrated in the low reluctance pathway through the pole pieces 110 and the case 140. The beveled tips 115 of the pole pieces 110 concentrate the magnetic field through the air gap 150 and the ferrimagnetic crystal resonator elements 160 contained therein.

The resonant frequency of the ferrimagnetic crystal resonator elements 160 is determined by the strength of the applied magnetic field. Input coupling means (not shown) apply electrical signals to the ferrimagnetic crystal resonator elements 160 which resonate in response to any of these electrical signals which are within their bandpass as determined by the strength of the magnetic field. Output coupling means (also not shown) sample the energy from the ferrimagnetic crystal resonator elements 160 and present the resulting bandpass filtered electrical output signal to the outside world.

Ferrimagnetic resonators with pole pieces of the prior art design tended to saturate at flux densities that were well below the theoretical limits for the materials involved. In exploring why this should be so, it was discovered that the flux density was first saturating in the vicinity of the right angle junction between the cylindrical pole piece and the magnet case. Further investigation revealed that any geometry which lessened this constriction by increasing the effective diameter of the pole piece in the region nearest to this junction served to increase the total flus density available at the pole tip. The lines of flux prefer a naturally curving path without the sharp bends imposed by the prior art geometry; a path that more closely approximates the path that the flux lines would take if the whole environment had uniform reluctance.

Figure 2A:
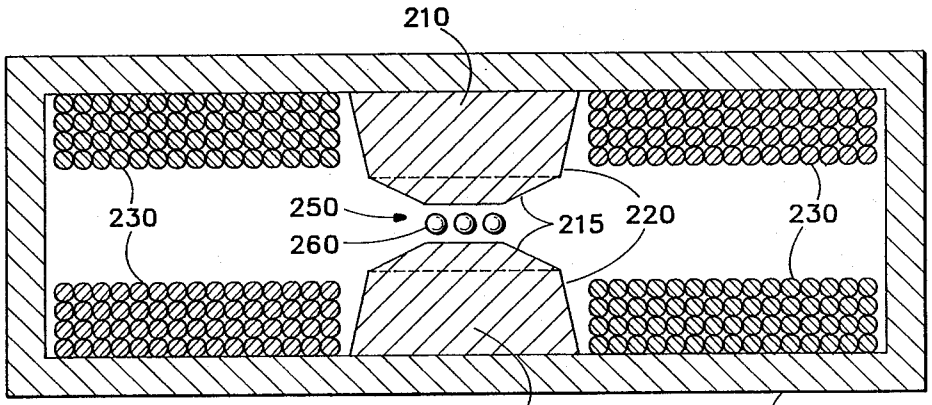
FIG. 2 is an illustration of the tuning magnet geometry of the present invention using a linear taper to achieve the different diameters.
FIG. 2B is an illustration of the tuning magnet geometry of the present invention using a series of steps to achieve the different diameters.
FIG. 2C is an illustration of the tuning magnet geometry of the present invention using a natural curvature to achieve the different diameters.

Referring now to FIG. 2A as well as to FIG. 1, the improved magnet design of the present invention incorporates the insight described above. The cylindrical pole shaft 120 has been replaced by a shorter and tapered pole shaft 220. The case 240 and coils 230 have both been modified to accommodate the differences in the shape of the new pole 210 that results. The same principles will also work with oval, or even rectangular, pole pieces. The only requirement is that the case end of the pole shaft 220 be somewhat enlarged relative to the tip end, so that the magnetic field can spread out so as provide a more gentle curvature into the case 240.

Figure 2B:
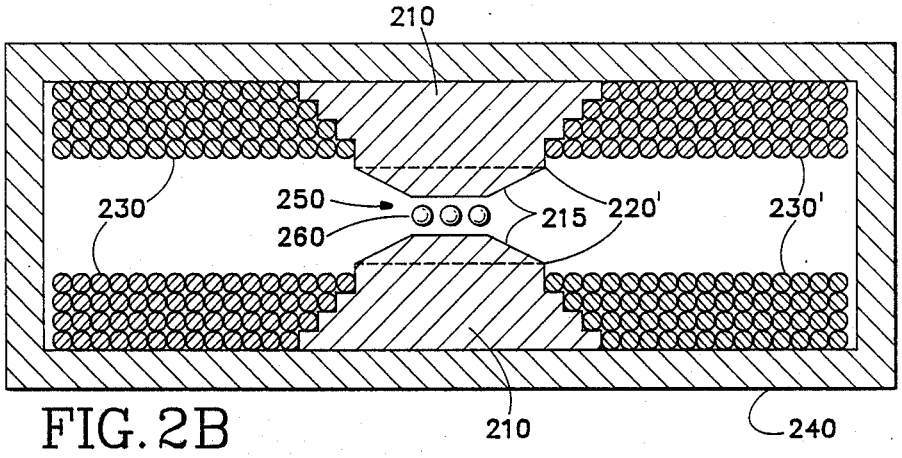
Figure 2C:
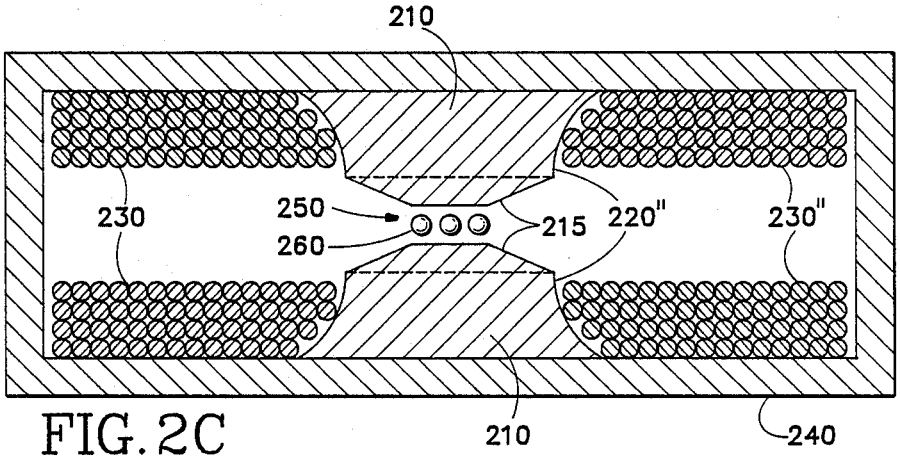

Referring now to FIGS. 2B and 2C, the same principle, of making the case end of the pole shaft larger than the tip end of the pole shaft, can also be effected by other geometries that allow for spreading of the field density toward the case end of the pole shaft. FIG. 2B shows a stair-step approach to achieving the broadening of the case end of the pole shaft 220'. This approach permits the windings of the coil 230' to be supported by the stair-steps of the pole shaft 220'. FIG. 2C shows a natural curve, such as a logrithmic curve, being used as the shape of the sides of the pole shaft 220''. This approach, while more difficult to fabricate, most closely matches the natural curvature of lines of magnetic flux in a medium of uniform reluctance.

The consequence of any of these changes is a magnet that can produce a greater flux density in the region of the air gap 250, thus allowing the overall ferrimagnetic resonator to be tunable to a much higher frequency. Whereas resonators of the old design using a 50% nickel, 50% iron alloy could only be tuned linearly over a frequency range of 2 GHz to about 20 GHz, resonators with one of these new pole geometries using the same alloy can now reach frequencies of up to 40 GHz. Furthermore, the use of this technique, in conjunction with another technique to be described below, can extend this frequency range even further, to the vicinity of 60 GHz.

In many applications where ferrimagnetic resonators are used, the strength of the applied magnetic field is varied systematically over time to produce a swept frequency output. In these circumstances, the hysteresis of the electromagnet presents a problem because the frequency of the resonator depends on the history of the applied magnetic field, as well as on the current state of the applied magnetic field. For this reason, magnets of some alloys, such as 80% nickel and 20% iron, that have a low hysteresis are desirable for many applications. However, there is in general a correlation between hysteresis and permeability, so that there is always a trade-off between the materials that are best for minimizing hysteresis and those that are best for maximizing the strength of the magnetic field before saturation occurs.

Figure 3:
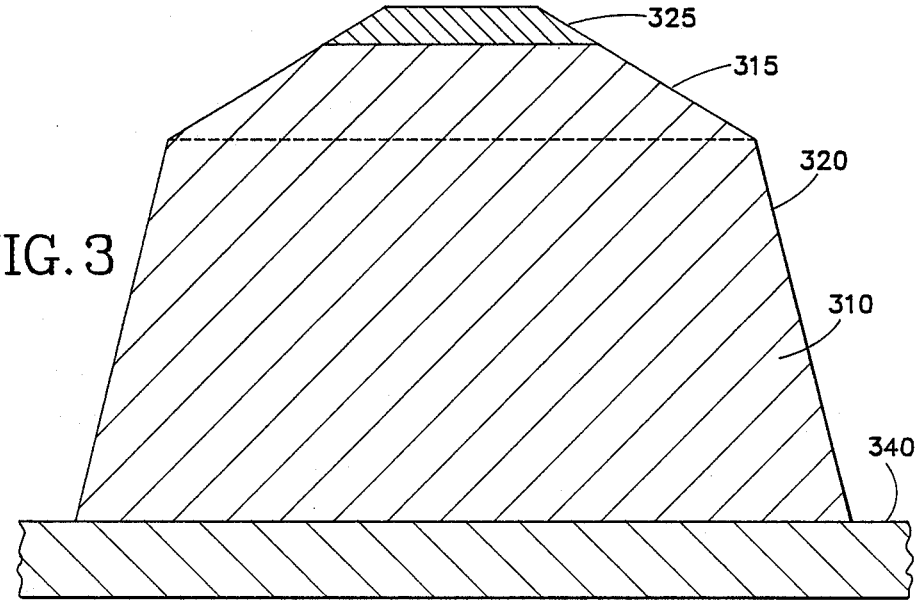
FIG. 3 is an illustration of a magnet pole according to the present invention that employs a second alloy at the pole tip.

The trade-off between saturation properties and hysteresis properties can be eased by the use of a pole tip that has at its terminal end a final layer of an alloy of the higher hysteresis, higher saturation type. Referring now to FIG. 3, a small layer of cobalt-iron alloy (50% to 50%) is seen as a cap 325 on the beveled tip 315 portion of pole piece 310. The small size of this layer minimizes the negative hysteresis effects, while its location at the point where the magnetic field must be most concentrated optimizes the benefit from using it to increase the flux density where it is most important to do so.

Figure 4:
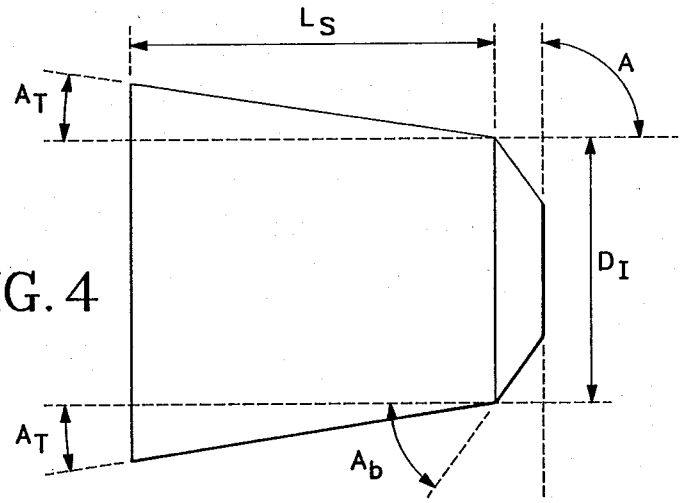
FIG. 4. is a dimensional drawing of the pole piece of the invention showing the dimensions chosen for a preferred embodiment.

FIG. 4. is a dimensional drawing of the preferred embodiment of the invention. The actual dimensions used in this embodiment are given in the following table:

TABLE OF ACTUAL DIMENSIONS

| LABEL | DESCRIPTION | VALUE |
|---|---|---|
| Ls | Length of shaft | 0.678 in. |
| At | Angle of taper | 10 deg. |
| Di | Diameter, inner shaft | 0.418 in. |
| Ab | Angle of bevel | 30 deg. |

In general, the critical parameters for the operability of the invention are the ratio of Ls/Di, and the angle of the taper, At. To have the shaft be sufficiently short, the ratio of the length of the shaft, Ls, and the inner diameter of the shaft, Di, should be no greater than two and a half to one. To have the case end of the shaft be sufficiently larger in diameter relative to the tip end of the shaft, the angle of the taper, At, should not be much less than ten degrees. Values less than these would still provide some benefit, but full realization of the potential of the invention would seem to require these minimum values for these parameters.

The angle of the bevel, Ab, is commonly chosen to be 60 degrees, even though the theoretical calculation of the complement of this angel given in several texts and articles on the subject is a value of 54 degrees, 44 minutes. This theoretical value is for a fully saturated pole piece, so several degrees are usually added in practice to compensate for the fact that most real world pole pieces are not in fact usually fully saturated.

The angle A shown in FIG. 4 is the angle between the face of the tip and the central axis of the pole. One would expect it to be 90 degrees, but in practice several manufacturers and users of these magnets have developed a preference for having this angle be approximately 89 degrees instead. With both opposing pole faces inclined away from perpendicular to the pole's axes by this 1 degree, rotation of the pole pieces can be used to adjust the uniformity of the field in the gap so as to provide a tuning capability for the ferrimagnetic crystal resonating elements which are suspending in the gap. This is an especially important consideration when multiple resonating elements are being used.

In the preferred embodiment of the ferrimagnetic resonator which first employed the present invention, the ferrimagnetic crystal resonating element is the Lithium-Aluminum-Iron type, rather than YIG, because a lower Q bandpass characteristic was desired.

While a preferred embodiment of the present invention has been shown and described, it will be apparent to those skilled in the art that many changes and modifications may be made without departing from the invention in its broader aspects. The following claims are therefore intended to cover all such changes and modifications as fall within the true scope and spirit of the invention.

I claim:

1. A ferrimagnetic resonator comprising:

a ferrimagnetic crystal resonating element; and an electromagnet positioned to apply an adjustable magnetic field to the ferrimagnetic crystal resonating element, the electromagnet having:

a pole piece, the pole piece having:

pole tip, and a pole shaft having a case end and a tip end, with the case end of the pole shaft having larger cross-sectional dimensions than the tip end; and with the pole shaft having a maximum length that is less than two and a half times the longest cross-sectional dimension of the pole shaft at the tip end;

a coil disposed to energize the pole piece with a magnetic field; and a case disposed to provide a low reluctance return path for the magnetic field produced by the coil in the pole piece.

2. A ferrimagnetic resonator as in claim 1 wherein the pole tip comprises an outer layer of an alloy having relatively higher permeability and hysteresis and an inner layer of an alloy having a relatively lower permeability and hysteresis.

3. A ferrimagnetic resonator as in claim 2 wherein the alloy having the relatively higher permeability and hysteresis consists essentially of cobalt and iron, and the alloy having the relatively lower permeability and hysteresis consists essentially of nickel and iron.

4. A ferrimagnetic resonator as in claim 1 wherein the larger cross-sectional dimensions of the pole shaft at the case end arise from a linear taper between the tip end and the case end.

5. A ferrimagnetic resonator as in claim 1 wherein the larger cross-sectional dimensions of the pole shaft at the case end arise from a series of steps between the tip end and the case end.

6. A ferrimagnetic resonator as in claim 1 wherein the larger cross-sectional dimensions of the pole shaft at the case end arise from a curvature between the tip end and the case end.

* * * * *